US008214933B1

(12) United States Patent
Gaudin

(10) Patent No.: US 8,214,933 B1
(45) Date of Patent: Jul. 10, 2012

(54) TOILET ACTUATING SYSTEM

(76) Inventor: Jean N. Gaudin, North Miami Beach, FL (US)

( * ) Notice: Subject to any disclaimer, the term of this patent is extended or adjusted under 35 U.S.C. 154(b) by 427 days.

(21) Appl. No.: 12/484,033

(22) Filed: Jun. 12, 2009

(51) Int. Cl.
*A47K 13/00* (2006.01)

(52) U.S. Cl. ..... 4/246.1

(58) Field of Classification Search . 4/249, 246.1–246.4
See application file for complete search history.

(56) References Cited

U.S. PATENT DOCUMENTS 5,056,165 A * 10/1991 Wescott, Sr. ..... 4/246.1
5,339,468 A * 8/1994 Lin ..... 4/246.5
6,651,262 B1 * 11/2003 Tinsley ..... 4/246.1
6,907,621 B2 * 6/2005 Stemen ..... 4/246.1
6,968,579 B1 * 11/2005 Feinberg et al. ..... 4/246.1

* cited by examiner

*Primary Examiner* — Charles Phillips

(57) ABSTRACT

A toilet actuating system includes a flush pedal, at least one seat/lid pedal, a control unit interfacing with the flush pedal and the at least one seat/lid pedal, a toilet flush mechanism engaged by the control unit and at least one of a toilet seat and a toilet lid engaged by the control unit.

1 Claim, 4 Drawing Sheets

TOILET ACTUATING SYSTEM

FIELD OF THE INVENTION

The present disclosure relates to toilets. More particularly, the present disclosure relates to a toilet actuating system for actuating the seat, lid and flush functions of a toilet using foot-actuated pedals.

BACKGROUND OF THE INVENTION

Conventionally, toilets require that a user manually lift a toilet lid and seat when necessary. Some toilets require that a flush handle be manually depressed to actuate flushing of the toilet. However, many users of toilets are uneasy about touching these parts of a toilet, particularly in public restrooms, due to fear of contamination.

Therefore, a toilet actuating system for actuating the seat, lid and flush functions of a toilet using foot-actuated pedals is needed.

SUMMARY OF THE INVENTION

The present disclosure is generally directed to a toilet actuating system. An illustrative embodiment of the toilet actuating system includes a flush pedal, at least one seat/lid pedal, a control unit interfacing with the flush pedal and the at least one seat/lid pedal, a toilet flush mechanism engaged by the control unit and at least one of a toilet seat and a toilet lid engaged by the control unit.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the embodiments of the disclosure and are not intended to limit the scope of the appended claims. Furthermore, there is no intention to be bound by any expressed or implied theory presented in the preceding technical field, background, brief summary or the following detailed description.

Figure 1:
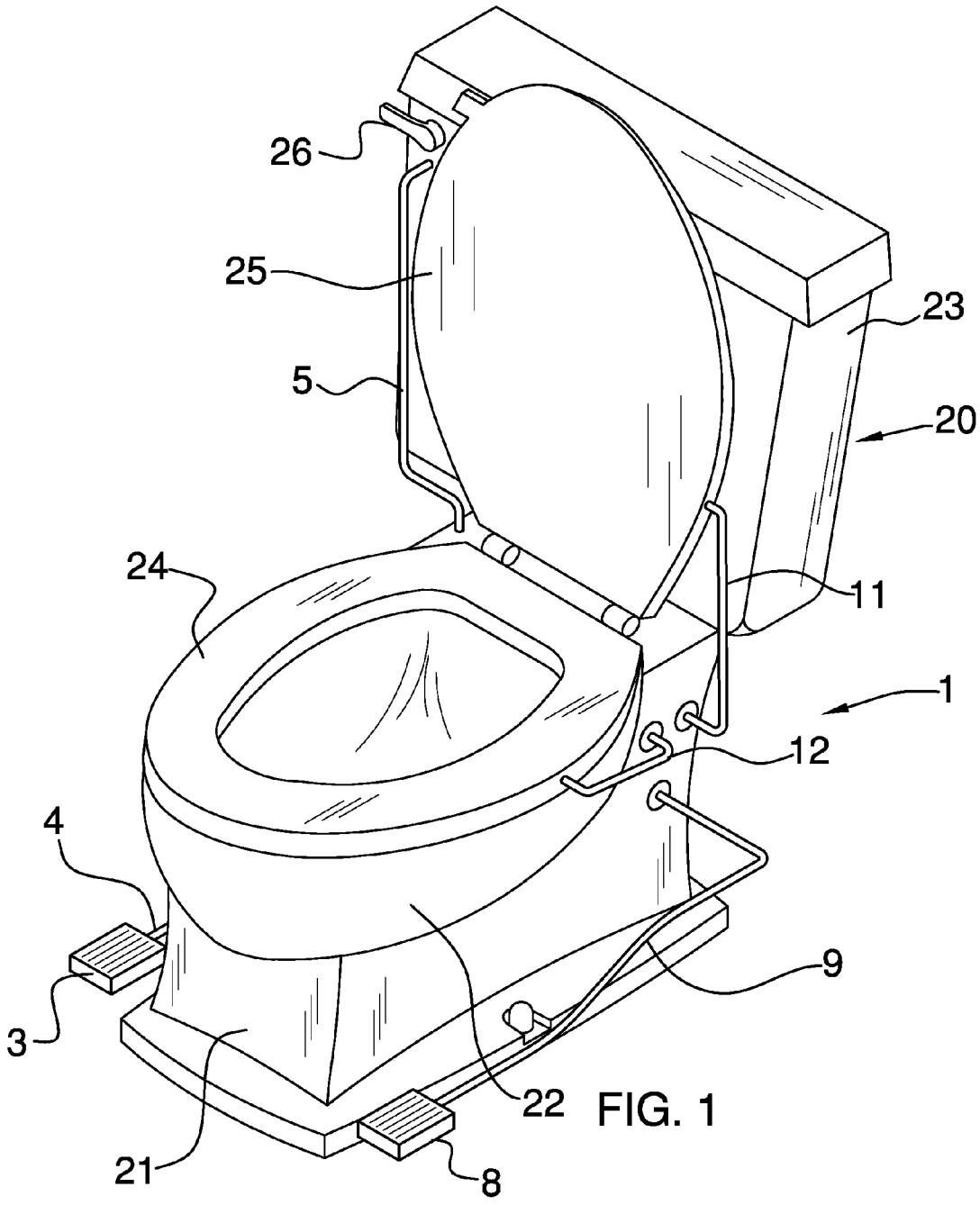
FIG. 1 is a perspective view of a toilet in implementation of an illustrative embodiment of the toilet actuating system.
Figure 2:
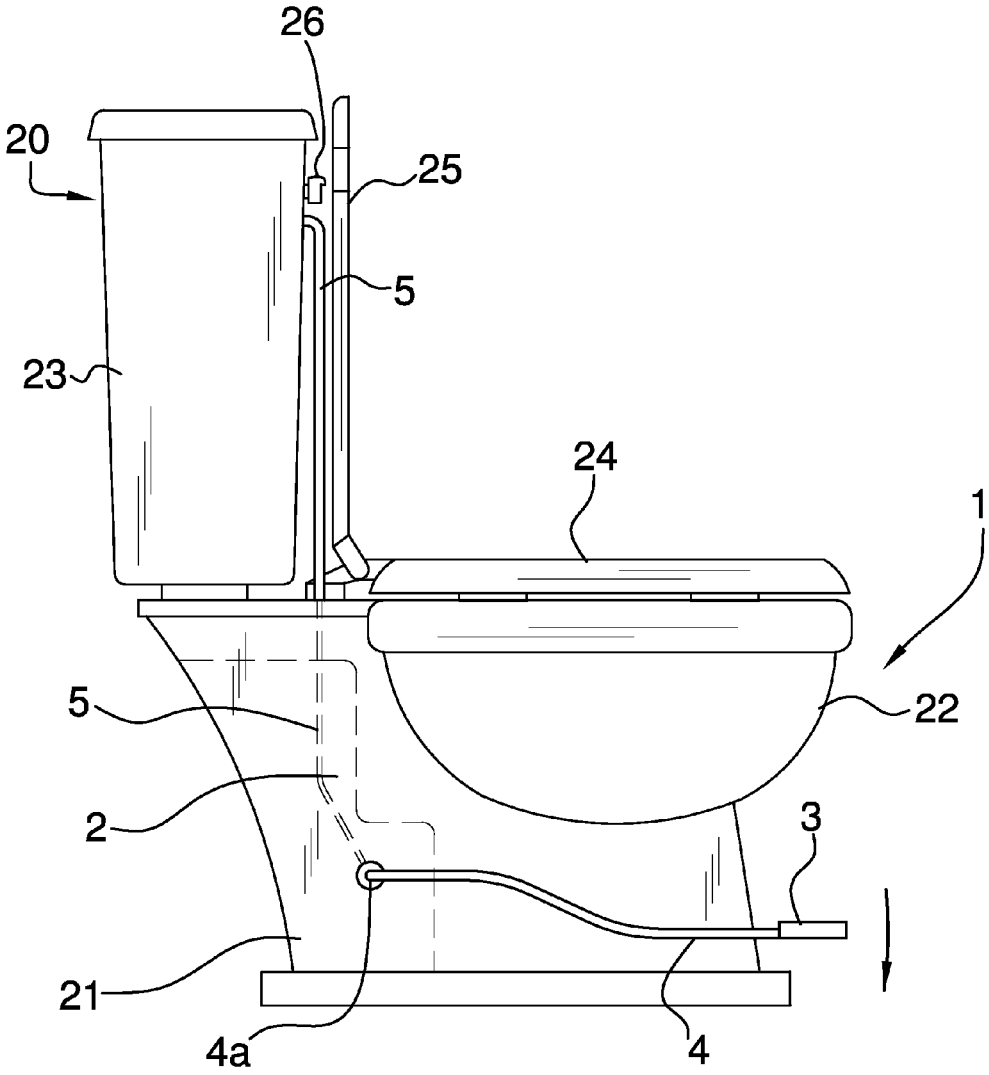
FIG. 2 is a right side view of the toilet in implementation of an illustrative embodiment of the toilet actuating system.
Figure 3:
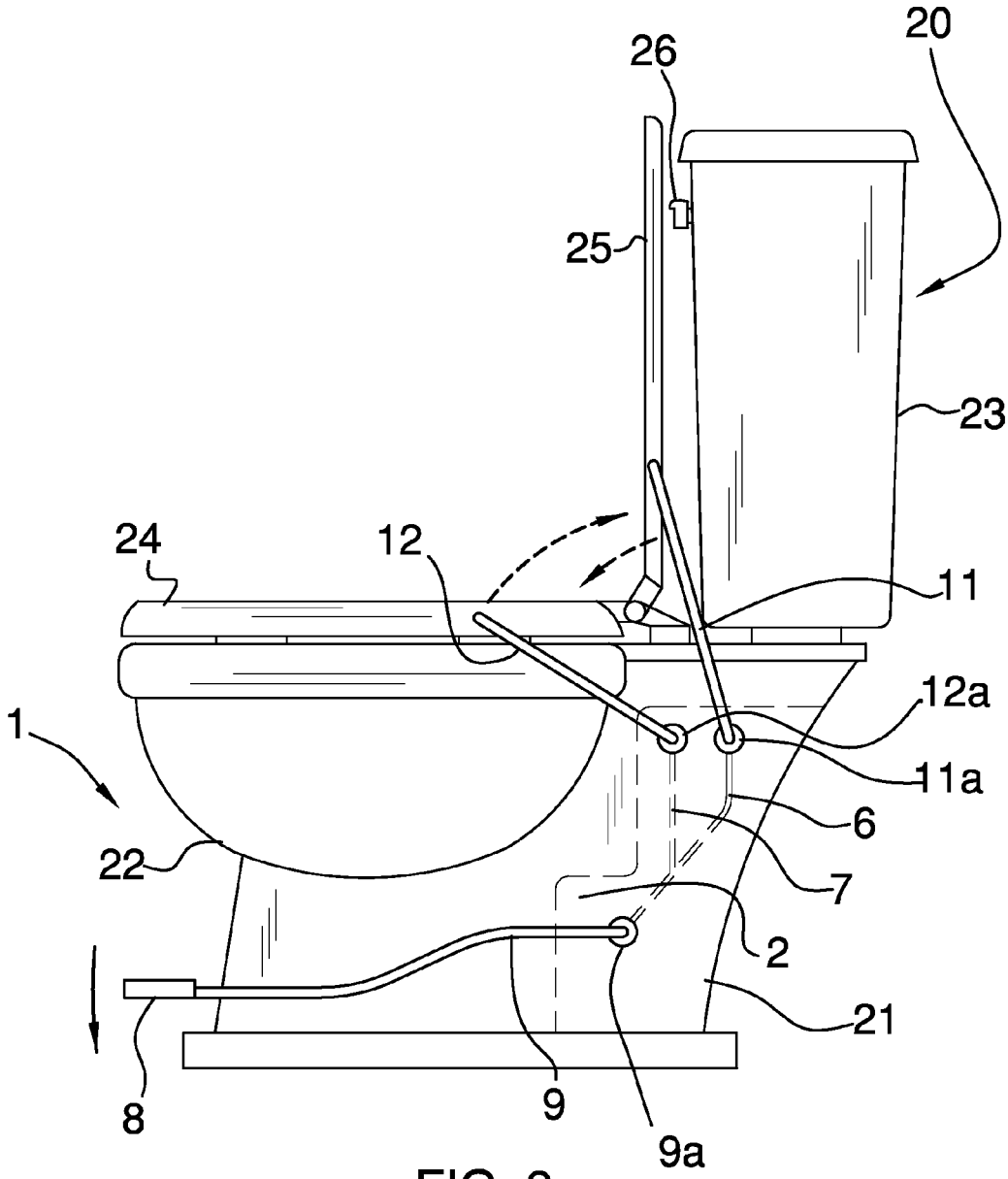
FIG. 3 is a left side view of the toilet in implementation of an illustrative embodiment of the toilet actuating system.

Referring to the drawings, an illustrative embodiment of the toilet actuating system, hereinafter system, is generally indicated by reference numeral 1. The system 1 may be fitted to a toilet 20 which may have a conventional design. As shown in FIGS. 1-3, the toilet 1 may include a toilet base 21 with a toilet bowl 22 and a water tank 23 provided on the toilet base

21. A toilet seat 24 may be pivotally attached to the toilet bowl 22. A toilet lid 25 may be pivotally attached to the toilet bowl to close the toilet seat 24 and toilet bowl 22. The water tank 23 may be fitted with a toilet flushing mechanism 26 which facilitates flushing of the toilet bowl 22.

Figure 4:
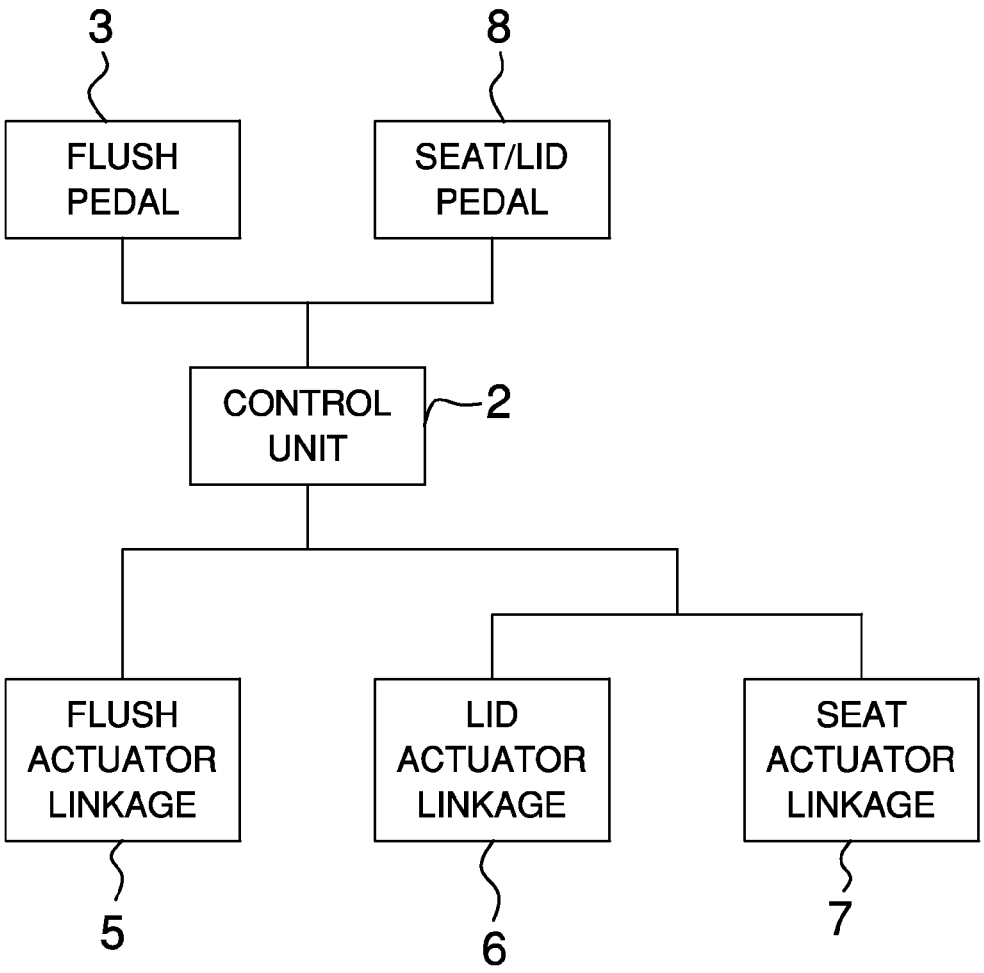
FIG. 4 is a schematic block diagram of an illustrative embodiment of the toilet actuating system.

As shown in FIG. 4, the system 1 may include a flush pedal 3 and a seat/lid pedal 8. A control unit 2 may interface with the flush pedal 3 and the seat/lid pedal 8. A flush actuator linkage 5, a lid actuator linkage 6 and a seat actuator linkage 7 may interface with the control unit 2. The flush actuator linkage 5 may interface with a flush mechanism (not shown) provided in the water tank 23 of the toilet 20. The lid actuator linkage 6 and the seat actuator linkage 7 may engage the toilet lid 25 and the toilet seat 24, respectively, of the toilet 20 typically in a manner which will be hereinafter described.

As shown in FIG. 2, the control unit 2 (shown in phantom) of the system 1 may be provided in the toilet base 21 of the toilet 20. The flush pedal 3 may be provided on a flush pedal shaft 4. The flush pedal shaft 4 may extend into a side of the toilet base 21 of the toilet 20 through a shaft opening 4*a* and engage the control unit 2. In the toilet base 21, the control unit 2 may engage the flush actuator linkage 5, which may extend upwardly through a linkage opening (not shown) provided in the top of the toilet base 21 and extends into the water tank 23 through a linkage opening (not shown). In the water tank 23, the flush actuator linkage 5 operably engages a flush mechanism (not shown) of the toilet 20. Accordingly, responsive to depression of the flush pedal 3, the control unit 2 actuates the flush mechanism 26 in the water tank 23, which initiates the flush function of the toilet 20.

As shown in FIG. 3, the lid/seat pedal 8 may be provided on a lid/seat pedal shaft 9. The lid/seat pedal shaft 9 may extend into a side of the toilet base 21 of the toilet 20 through a shaft opening 9*a* and engage the control unit 2. In the toilet base 21, the lid actuator linkage 6 may engage a lid arm 11 which extends from the toilet base 21 through an arm opening 11*a*. The seat actuator linkage 7 may engage a seat arm 12 which extends from the toilet base 21 through an arm opening 12*a*. The lid arm 11 engages the toilet lid 25, and the seat arm 12 engages the toilet seat 24. Accordingly, responsive to depression of the seat/lid pedal 8, the control unit 2 may be adapted to raise the toilet lid 25 from the toilet seat 24 via the lid arm 11. Responsive to further depression of the seat/lid pedal 8, the control unit 2 may be adapted to raise the toilet seat 24 from the toilet bowl 22 via the seat arm 12. In some embodiments, the control unit 2 may be adapted to automatically close the toilet seat 24 on the toilet bowl and the toilet lid 25 on the toilet seat 24 after flushing of the toilet 20 via actuation of the flush pedal 3. In some embodiments, the lid arm 11 and the seat arm 12 may be actuated via separate foot pedals according to the knowledge of those skilled in the art.

In typical operation of the system 1, a user (not shown) of the toilet 20 raises the toilet lid 25 from the toilet seat 24 and may additionally raise the toilet seat 24 from the toilet bowl 22 by depressing the seat/lid pedal 8 with his or her foot. After using the toilet 20, the user flushes the toilet 20 by depressing the flush pedal 3. The control unit 2 may then automatically lower the toilet seat 24 onto the toilet bowl 22 and the toilet lid 25 onto the toilet seat 24 via the seat arm 12 and the lid arm 11, respectively. Accordingly, the flush functions of the toilet 20, as well as raising and lowering of the toilet seat 24 and the toilet seat 25, may be actuated without the need of the user to manually touch any components of the toilet 20.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A toilet bowl and tank in combination with a toilet actuating system, comprising:

a toilet bowl having a toilet base;

a control unit situated in said toilet base;

a toilet tank situated on said toilet bowl said toilet having a toilet flushing mechanism;

a flush pedal;

a flush pedal shaft extending from said flush pedal, said flush pedal shaft extending through an opening in said toilet base so as to interface with said control unit;

a flush actuator linkage engaged by said control unit, said flush actuator linkage extending from said toilet base into said toilet tank so as to be able to actuate said toilet flushing mechanism;

at least one seat/lid pedal;

at least one seat/lid pedal shaft extending from said at least one seat/lid pedal through an opening in said toilet base and engaged by said control unit;

a lid actuator linkage engaged by said control unit;

a lid arm engaged by said lid actuator linkage, said lid arm extending through an opening in said base to engage a toilet lid;

a seat actuator linkage engaged by said control unit;

a seat arm engaged by said seat actuator linkage, said seat arm extending through an opening in said base to engage a toilet seat;

wherein said toilet may be flushed by actuation of said flush pedal and a seat and or lid may be operated by actuation of said seat/lid pedal.

* * * * *